US007216907B1

(12) United States Patent
Mussman et al.

(10) Patent No.: US 7,216,907 B1
(45) Date of Patent: May 15, 2007

(54) BRACKET FOR SNOW SHOVEL

(75) Inventors: Richard W. Mussman, Clarion, IA (US); Jeffrey W. Mussman, Clarion, IA (US)

(73) Assignee: R & M Supplies & Mfg., Clarion, IA (US)

( * ) Notice: Subject to any disclaimer, the term of this patent is extended or adjusted under 35 U.S.C. 154(b) by 0 days.

(21) Appl. No.: 11/307,116

(22) Filed: Jan. 24, 2006

(51) Int. Cl.
*E01H 5/02* (2006.01)

(52) U.S. Cl. ..... 294/49; 294/54.5

(58) Field of Classification Search ..... 294/49, 294/54.5, 51, 57, 59; D8/10
See application file for complete search history.

(56) References Cited

U.S. PATENT DOCUMENTS 1,042,352 A * 10/1912 Kohler ..... 294/54.5
4,538,847 A * 9/1985 Lapshansky ..... 294/51
D294,233 S * 2/1988 Myers ..... D8/10
D373,292 S 9/1996 Motley
D392,521 S 3/1998 Tisbo et al.
D395,212 S 6/1998 Vosbikian
5,826,930 A * 10/1998 Whitehead et al. ..... 294/54.5
D417,826 S * 12/1999 Yacobi et al. ..... D8/10
D433,889 S 11/2000 Spear
D434,287 S * 11/2000 Spear ..... D8/10
6,497,439 B1 * 12/2002 Guo ..... 294/54.5

* cited by examiner

*Primary Examiner*—Patrick Mackey
*Assistant Examiner*—Paul T. Chin

(57) ABSTRACT

A shovel having a handle connected to an elongated shaft that is connected to a blade. The shaft is connected to the blade by a bracket having a hollow cylinder, a support member, and a support plate. The hollow cylinder is formed to receive one end of the shaft. The support member is connected to the support plate and has a concave arcuate bottom surface formed to receive a curved portion of the blade. The support plate is fixedly connected to the blade.

7 Claims, 5 Drawing Sheets

BRACKET FOR SNOW SHOVEL

BACKGROUND OF THE INVENTION

This invention is directed toward a snow shovel and more specifically a molded one-piece bracket for a snow shovel.

Snow shovels are well known in the art. Typically, a snow shovel has a handle attached to a shaft which is attached to a blade. The shaft generally is attached to the blade by a bracket that receives a portion of the shaft and is bolted or welded to the back of the blade. To provide additional support, a brace is attached to the shaft above the bracket and attached to the blade outwardly of the bracket. While the bracket and brace connect the shaft to the blade and provide support during operation, the combination increases the time for assembly and because of the number of parts increases the cost to manufacture. Thus, there is a need in the art for a shovel that addresses these problems.

An objective of the present invention is to provide a snow shovel that is easy to assemble.

Another objective of the present invention is to provide a snow shovel made of fewer parts that is more economical to manufacture.

These and other objectives will be apparent to those skilled in the art based on the following written description.

SUMMARY OF THE INVENTION

A shovel having a handle connected to an elongated shaft that is connected to a blade. The shaft is connected to the blade by a bracket having a hollow cylinder, a support member, and a support plate. The hollow cylinder is formed to receive one end of the shaft. The support member is connected to the support plate and has a concave arcuate bottom surface formed to receive a curved portion of the blade. The support plate is fixedly connected to the blade.

DETAILED DESCRIPTION OF THE PREFERRED EMBODIMENT

Figure 1:
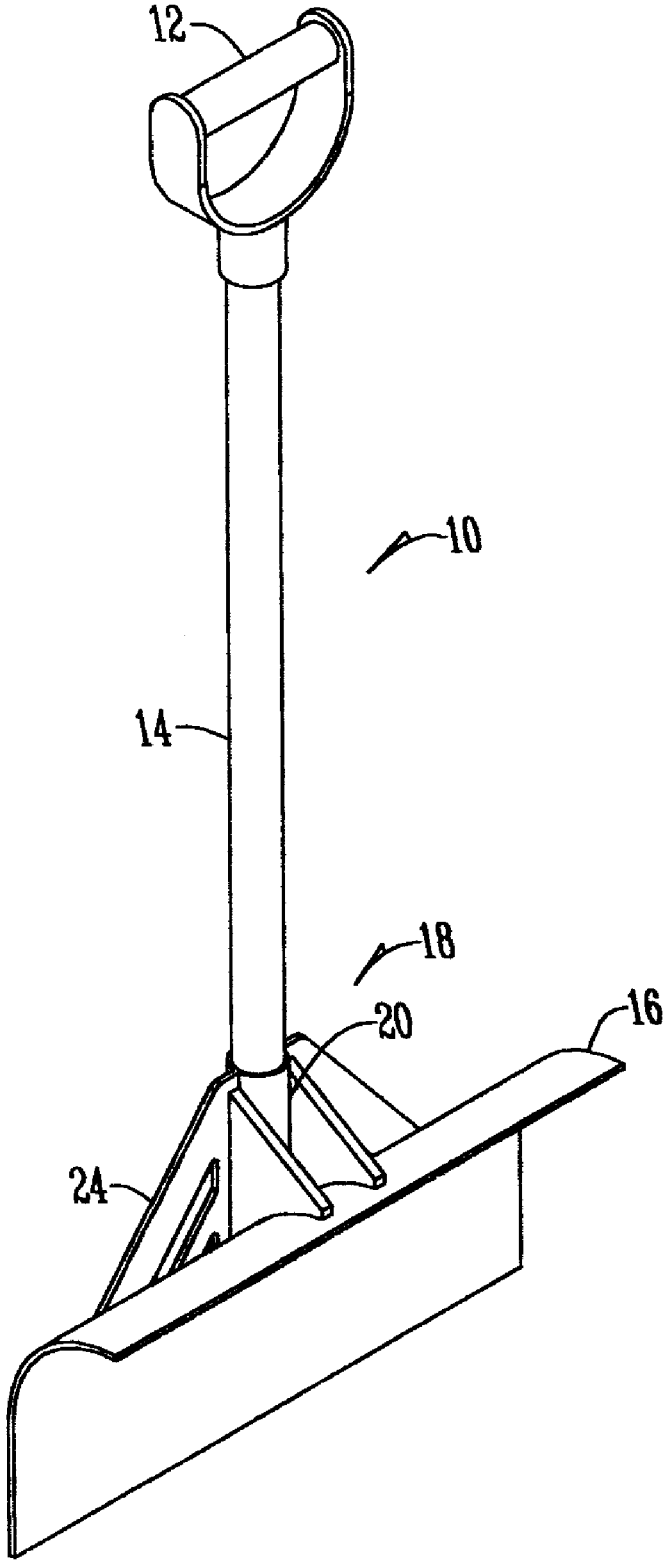
FIG. 1 is a perspective view of a shovel.
Figure 2:
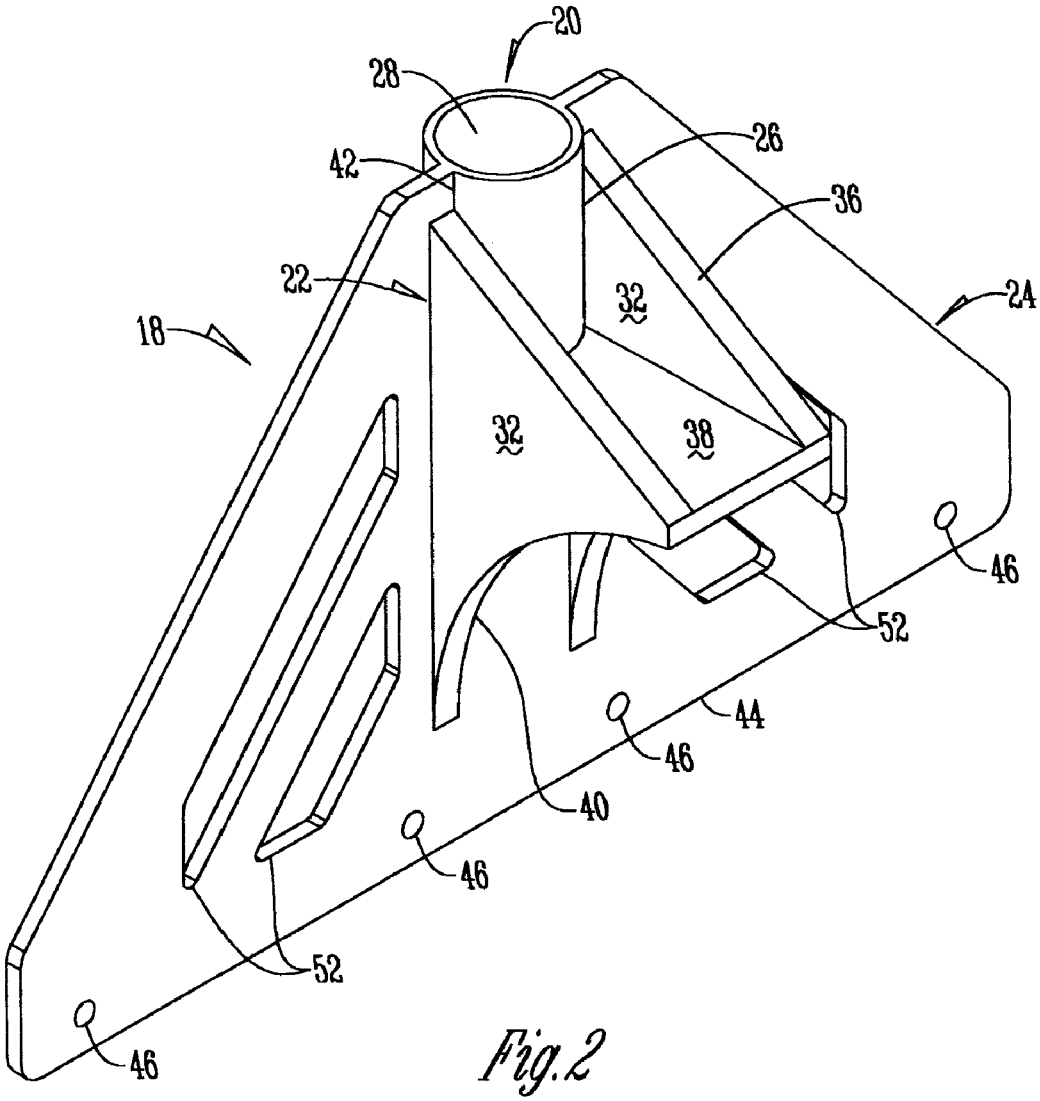
FIG. 2 is a perspective view of the back side of a bracket.
Figure 3:
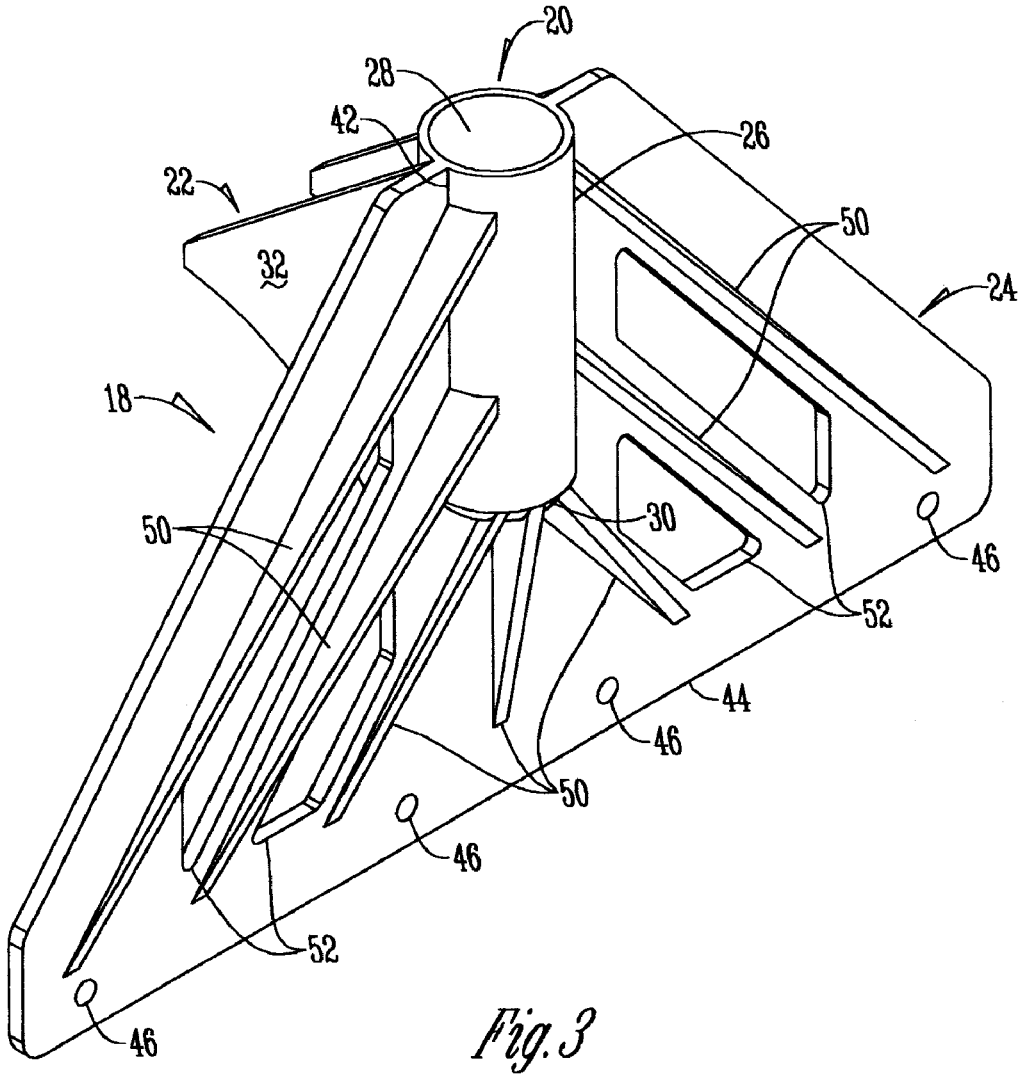
FIG. 3 is a perspective view of the front side of a bracket.
Figure 4:
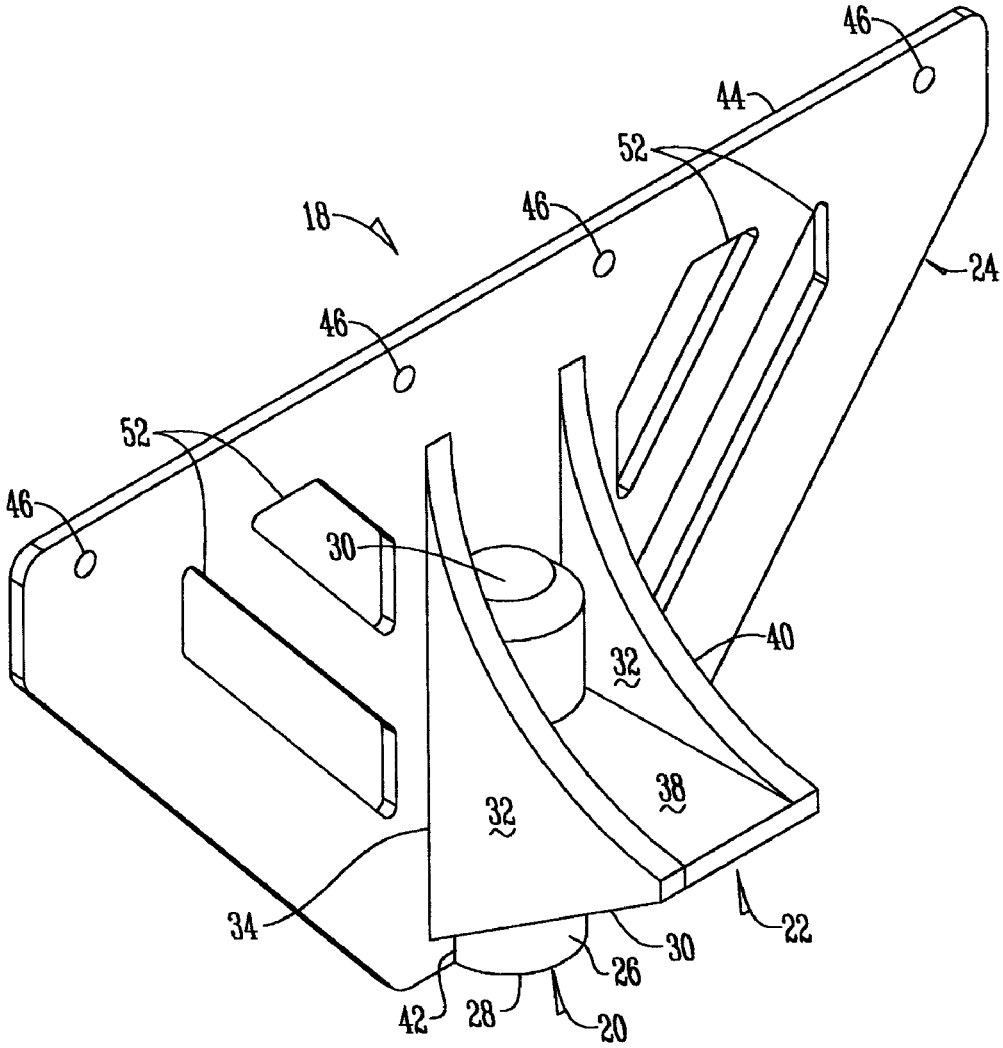
FIG. 4 is an additional perspective view of the back side of a bracket.
Figure 5:
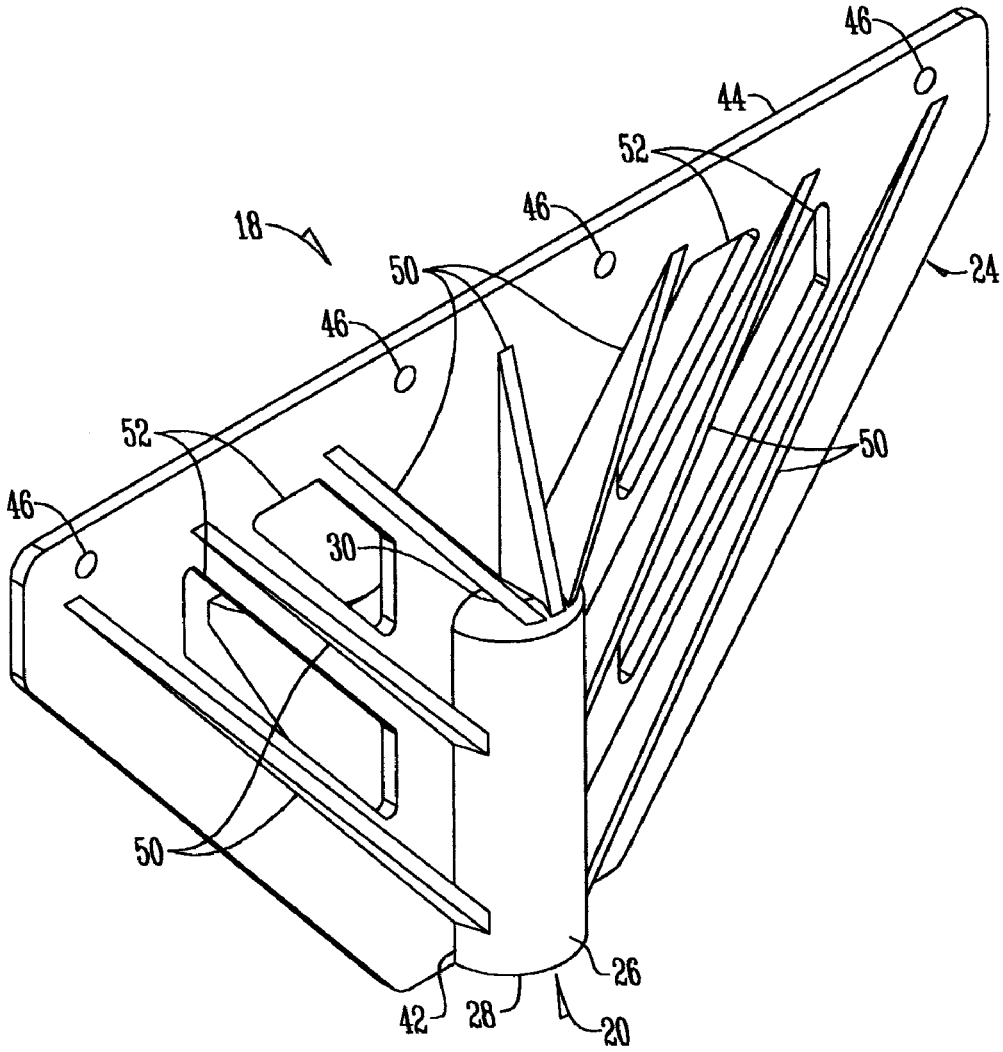
FIG. 5 is an additional perspective view of the front side of a bracket.

Referring to the Figures, a shovel 10 has a handle 12 that is connected to an elongated shaft 14. The handle 12 and shaft 14 can be made of a single piece without departing from the scope of the invention. At an end opposite the handle 12, the shaft 14 is connected to a blade 16. The shaft 14 is connected to the blade 16 by a bracket 18.

The bracket 18, is preferably made of molded plastic to form a single piece having a hollow cylinder 20, a support member 22, and a support plate 24. The hollow cylinder 20 has a cylindrical side wall 26 with an open end 28 and a closed end 30. The open end 28 of the hollow cylinder 20 is formed to receive an end of the shaft 14.

The support member 22 has a pair of spaced members 32 that are connected to the support plate 24 and extend along the length of the cylinder 20. The spaced members 32 have a vertical edge 34 that extends along the support plate 24 and an angled edge 36 that extends outwardly from the open end 28 toward the closed end 30. The edges 34 and 36 terminate in a bottom 38 that has a concave arcuate surface 40 formed to fit the curvature of the blade 16.

The support plate 24, preferably has a triangular shape with a slot 42 wherein the hollow cylinder 20 is disposed. Adjacent a bottom edge 44 are a plurality of connecting apertures 46 that are positioned for alignment with connecting apertures 46 on the blade 16. The support plate 24 is connected to the blade 16 by a plurality of screws or rivets that extend through the aligned apertures 46. Extending outwardly from cylinder 20 are a plurality of support fins 50. Preferably, the support fins 50 taper inwardly from an end connected to the cylinder toward an end connected to the support plate 24. Disposed between the fins are a plurality of slots 52.

To assemble the shovel 10, the bracket 18 is placed on the blade 16 such that the curvature of the blade 16 is received within the arcuate surface 40 of the bottom 38 of the support member 22, and such that apertures 46 of the blade 16 and support plate 24 are aligned. Rivets or screws are inserted through apertures 46 to secure the bracket 18 to the blade 16. The handle 12 and shaft 14 are connected to the bracket 18 by inserting an end of the shaft 14 into the hollow cylinder 20. The shaft 14 is secured to the bracket 18 either by frictional engagement, adding an adhesive material, or by a bolt and screw (not shown) that extend through cylinder 20 and shaft 14.

Therefore, a shovel having a bracket made of a single piece has been shown that is easy to assemble and more economical to manufacture and at least all of the stated objectives have been met.

What is claimed is:

1. A shovel, comprising:

an elongated shaft;

a bracket having a hollow cylinder formed to receive the shaft, a support member, and a support plate;

the support member having a concave arcuate bottom surface formed to receive a curved portion of a blade and a vertical edge that extends along the support plate;

the support plate being connected to the blade at a bottom edge;

the support plate having a plurality of support fins that extend from the hollow cylinder;

the support plate having a plurality of slots positioned between the fins; and the support member receiving the blade at the concave arcuate bottom surface and being connected to the support plate at the vertical edge such that the support member is disposed between the support plate and blade in wedge fashion.

2. The shovel of claim 1 wherein the support member has a pair of spaced members connected to the support plate that extend along a length of the cylinder.

3. The shovel of claim 2 wherein the spaced members extend perpendicular to the blade.

4. The shovel of claim 1 wherein the bracket is made of molded plastic.

5. The shovel of claim 1 wherein the bracket is formed of a single piece.

6. The shovel of claim 1 wherein the support plate has a plurality of connecting apertures adjacent the bottom edge.

7. A shovel, comprising:

an elongated shaft;

a bracket having a hollow cylinder formed to receive the shaft, a support member, and a support plate;

the support member having a concave arcuate bottom surface formed to receive a curved portion of a blade and a vertical edge that extends along the support plate;

the support plate being connected to the blade at a bottom edge;

the support member receiving the blade at the concave arcuate bottom surface and being connected to the support plate at the vertical edge such that the support member is disposed between the support plate and blade in wedge fashion wherein the support plate is connected to the support fins on a side and connected to the blade and support member on an opposite side.

* * * * *